US007806108B2

(12) United States Patent
Eck et al.

(10) Patent No.: US 7,806,108 B2
(45) Date of Patent: Oct. 5, 2010

(54) FEED UNIT

(75) Inventors: Karl Eck, Frankfurt (DE); Dieter Hagist, Lahnstein (DE); Matthias Kadler, Gross-Gerau (DE); Martin Maasz, Sulzbach (DE); Oliver Schönert, Arnsberg (DE); Michael Teichert, Schwalbach (DE)

(73) Assignee: Continental Automotive GmbH, Hannover (DE)

( * ) Notice: Subject to any disclaimer, the term of this patent is extended or adjusted under 35 U.S.C. 154(b) by 0 days.

(21) Appl. No.: 12/067,846

(22) PCT Filed: Sep. 21, 2006

(86) PCT No.: PCT/EP2006/066593

§ 371 (c)(1),
(2), (4) Date: Jul. 8, 2008

(87) PCT Pub. No.: WO2007/036484

PCT Pub. Date: Apr. 5, 2007

(65) Prior Publication Data

US 2008/0308071 A1 Dec. 18, 2008

(30) Foreign Application Priority Data

Sep. 30, 2005 (DE) ..... 10 2005 047 546

(51) Int. Cl.
*F02M 37/04* (2006.01)

(52) U.S. Cl. ..... 123/509; 417/410.5; 417/423.14; 418/55.1

(58) Field of Classification Search ..... 137/565.24, 137/574, 509, 565.01, 340; 417/360, 361, 417/363, 410.5, 423.14; 418/55.1; 166/68.5; 184/6.16; 123/509, 508; *F02M 37/04*
See application file for complete search history.

(56) References Cited

U.S. PATENT DOCUMENTS

| | | | | |
|---|---|---|---|---|
| 4,694,857 | A * | 9/1987 | Harris | 137/565.24 |
| 6,216,908 | B1 | 4/2001 | Hutter et al. | 220/562 |
| 7,237,538 | B2 * | 7/2007 | Perruchot et al. | 123/509 |
| 2007/0116581 | A1 | 5/2007 | Hagist et al. | 417/360 |

FOREIGN PATENT DOCUMENTS

| | | |
|---|---|---|
| DE | 195 34 411 B4 | 9/2005 |
| EP | 0 425 105 A1 | 5/1991 |
| EP | 1 502 795 A2 | 2/2005 |
| EP | 1 564 401 A1 | 8/2005 |
| JP | 60139528 | 7/1985 |
| WO | 2005053987 | 6/2005 |

* cited by examiner

*Primary Examiner*—Stephen K Cronin
*Assistant Examiner*—Keith Coleman
(74) *Attorney, Agent, or Firm*—King & Spalding L.L.P.

(57) ABSTRACT

A feed unit has a surge chamber 1, a fuel pump 2, which is arranged in the surge chamber 1, and a pump holder 3, the fuel pump 2 being arranged in the pump holder 3 and the pump holder 3 being fastened in the surge chamber 1. The pump holder 3 has at least two rods 6 which are fastened in the surge chamber 1, the rods 6 being connected to a mount 5 for the fuel pump 2.

20 Claims, 2 Drawing Sheets

FEED UNIT

CROSS-REFERENCE TO RELATED APPLICATIONS

This application is a U.S. national stage application of International Application No. PCT/EP2006/066593 filed Sep. 21, 2006, which designates the United States of America, and claims priority to German application number 10 2005 047 546.9 filed Sep. 30, 2005, the contents of which are hereby incorporated by reference in their entirety.

TECHNICAL FIELD

The invention relates to a feed unit having a surge chamber, a fuel pump arranged in the surge chamber and a pump holder, the fuel pump being arranged in the pump holder and the pump holder being fastened in the surge chamber. Feed units of this type are used for feeding fuel from the fuel container of a motor vehicle to an internal combustion engine of the motor vehicle.

BACKGROUND

Feed units of the type mentioned in the introduction have long been known in the prior art. In these units the pump holder of a feed unit serves to arrange the fuel pump in a fixed manner in the surge chamber, while it also has the function of damping vibrations generated by the fuel pump or to prevent them from being transmitted to the surge chamber. Undesired noises can be reduced in this way. Known in particular for damping vibrations of the fuel pump are numerous pump holders which have a first mount for mounting the fuel pump and a second mount for fastening the pump holder to the surge chamber. The two mounts are connected by an interposed damping element which has the function of preventing vibrations from being transmitted from the first mount to the second mount. The damping element is generally an elastic part which receives its elasticity through the selection of material, preferably rubber, or through its configuration, preferably in the form of a spiral or a meander. A disadvantage of these pump holders is their relatively complex shape, so that their manufacture is associated with considerable cost.

SUMMARY

A feed unit can be provided which is of simple construction and is therefore inexpensive. In addition, the feed unit may be suitable for various types of pump. According to an embodiment, a feed unit may comprise a surge chamber, a fuel pump arranged in the surge chamber and a pump holder, wherein the fuel pump is arranged in the pump holder and the pump holder is fastened in the surge chamber, the pump holder has at least two rods which are fastened in the surge chamber, and wherein the rods are connected to a mount for the fuel pump.

According to a further embodiment, the rods may be arranged axially parallel to the axial extension of the fuel pump and the length of the rods between the mount and the base of the surge chamber may correspond approximately to the length of the fuel pump. According to a further embodiment, the rods may be fastened in the base of the surge chamber by means of a plug-in connection. According to a further embodiment, the rods may be connected to the base of the surge chamber by a material joint. According to a further embodiment, the rods can be formed integrally on the base of the surge chamber. According to a further embodiment, the rods may be connected to the mount by means of a plug-in connection. According to a further embodiment, the diameter of the rods, starting at the end oriented away from the base of the surge chamber, may increase in steps or continuously. According to a further embodiment, the rods may be formed in one piece with the mount.

BRIEF DESCRIPTION OF THE DRAWINGS

The invention is explained the more detail with reference to an exemplary embodiment. In the drawings.

DETAILED DESCRIPTION

Figure 1:
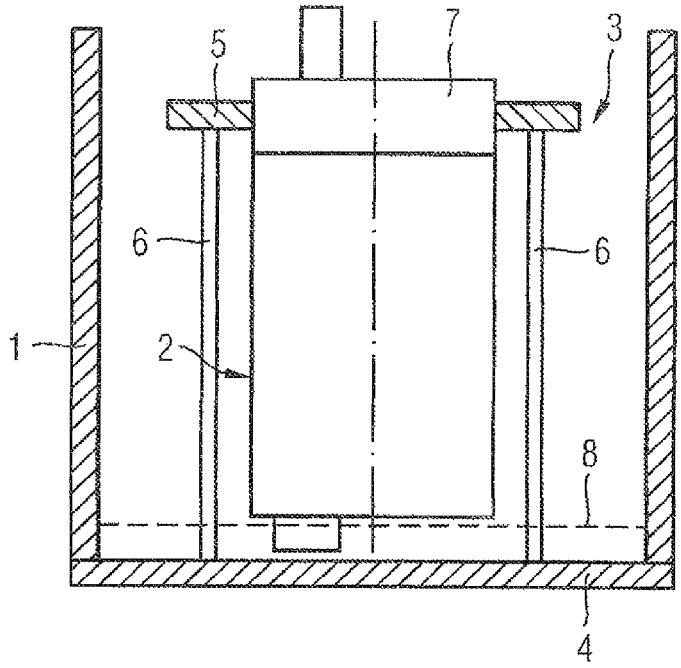
FIG. 1 is a schematic representation of a feed unit according to an embodiment in section.

According to various embodiments, the pump holder has at least two rods which are fastened in the surge chamber, and in that the rods are connected to a mount for the fuel pump.

With the use of the rods in the pump holder, the feed unit is distinguished by a very simple structure. As a result, the pump holder is easily manufactured, making the feed unit more inexpensive. In addition, with the use of rods in the pump holder, elements have been found which, because of their structure, firstly possess sufficient strength to act as fixing means and, secondly, have sufficient elasticity to damp vibrations. The vibrations generated by the fuel pump are therefore effectively decoupled from the surge chamber.

Especially good decoupling of the surge chamber from the vibrations of the fuel pump is achieved with rods which are arranged axially parallel to the axial extension of the fuel pump, and where the length of the rods between the mount and the base of the surge chamber corresponds approximately to the length of the fuel pump. In these cases the rods extend from the base of the surge chamber to the region of the connecting piece of the fuel pump. Through this arrangement the rods have great length, with which especially high elasticity for vibration damping is achieved.

With relatively smooth-running fuel pumps which tend to produce less vibration as a result of their structure, the length of the rods between the mount and the base of the surge chamber can be reduced, so that the fuel pump is not mounted in the region of the connecting piece but is mounted centrally in relation to its axial extension.

An especially simple fastening of the rods in the base of the surge chamber is achieved by means of a plug-in connection, in particular via a press fit.

A connection between the rods and the surge chamber which has especially high load capacity is achieved with a material joint, for example by means of welding.

In another configuration, retrospective mounting of the rods in the surge chamber is avoided in that the rods are formed integrally on the base of the surge chamber.

In a further configuration, the rods are connected to the mount in an especially simple manner by means of a plug-in connection.

The pump holder can be adapted with low cost and complexity to different fuel pumps, in particular pump lengths, if the diameter of the rods, starting at the end oriented away from the base of the surge chamber, increases in steps or continuously. By a correspondingly configured diameter of the mount, the mount can thus be arranged at desired heights with respect to the rods. The advantage of this arrangement is that the rods do not need to be adapted separately to different fuel pumps. Rather, one rod size can be used for all variants.

According to another configuration, installation of the rods with the mount can also be avoided by a one-piece configuration of the rods with the mount.

The mount has a very simple structure if it has a short extension in the axial direction. Provided the rods are configured to extend into the region of the connecting piece of the fuel pump, with such a mount the fuel pump is mounted in the region of the connecting piece.

However, as a result of the configuration of the fuel pump, it may be necessary to mount the fuel pump in the middle or at the opposite end, in the region of the pump step. In order nevertheless to achieve sufficient decoupling of the surge chamber from the vibrations of the fuel pump, it has proved advantageous to use a pot-shaped mount and rods of sufficient length. With this configuration the length of the rods can be retained unchanged. Adaptation of the pump holder to the mounting point of the fuel pump in the mount is now achieved via the length of the pot-shaped configuration of the mount.

The feed unit represented in FIG. 1 consists of a surge chamber 1 in which is arranged a fuel pump 2. The fuel pump 2 is mounted in a pump holder 3 and is connected via the latter to the base 4 of the surge chamber 1.

The pump holder 3 consists of a mount 5 and three rods 6. The rods 6 are pressed into openings in the base 4, passing through a pump prefilter 8. The rods 6 extend parallel to the axis of the fuel pump 2 up to the height of the connecting piece 7, where their ends oriented away from the base 4 are pressed into openings in the mount 5. With regard to its axial extension, the mount 5 of the pump holder 3 is limited to the connecting piece 7 of the fuel pump 2.

Figure 2:
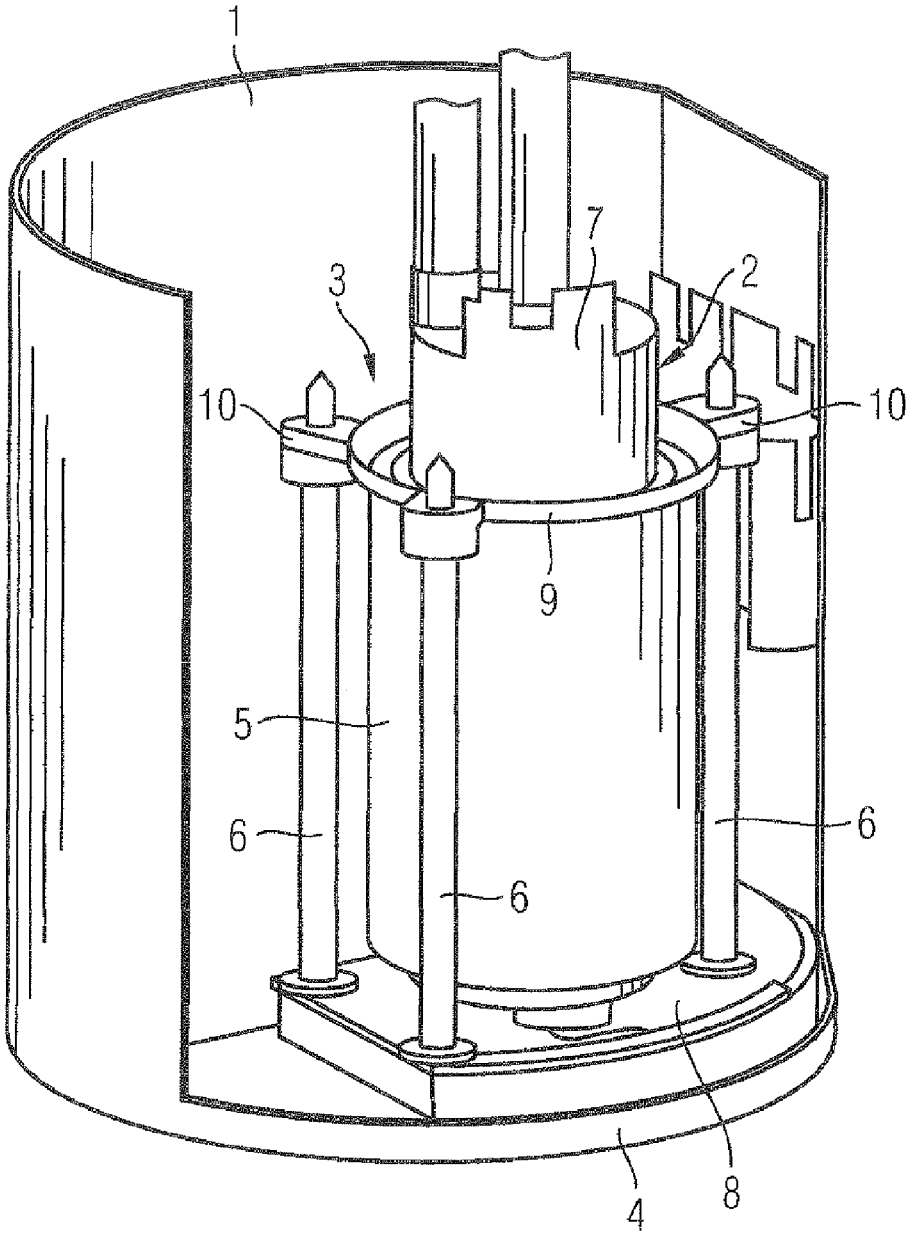
FIG. 2 shows a section through the surge chamber according to FIG. 1 in a perspective representation.

A fuel pump 2 is arranged in the surge chamber 1, shown in a cut-away representation in FIG. 2. The fuel pump 2 is mounted in the mount 5 of a pump holder 3, the mount 5 having a pot-shaped configuration, so that it receives almost the entire fuel pump 2. The upper end of 9 of the mount 5 extends into the region of the connecting piece 7 of the fuel pump 2. Connection points 10 into which the three rods 6 are pressed are formed integrally on the upper end 9. The rods 6 are connected by their other ends to the base 4 of the surge chamber 1. Arranged below the mount 5 is a pump prefilter 8 through which the rods 6 pass. The rods 6 are therefore disposed axially parallel to the fuel pump 2. Because the rods 6 extend into the region of the connecting piece 7 of the fuel pump 2, they possess through their length sufficient elasticity to decouple vibrations of the fuel pump 2 effectively with respect to the surge chamber 1.

Figure 3:
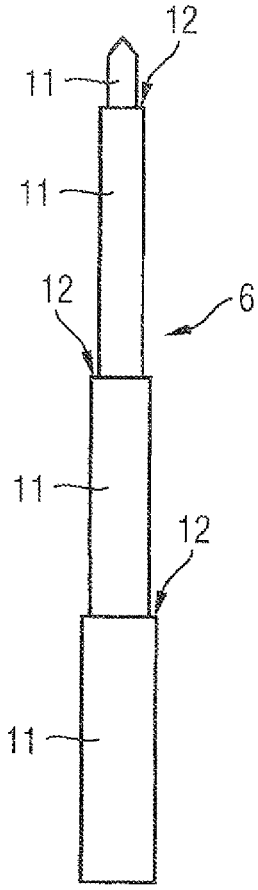
FIG. 3 shows a further embodiment of the rods of the pump holder.

The rod 6 of a pump holder 3 shown in FIG. 3 has a plurality of regions 11 of different diameters, the diameters of the regions 11 increasing in steps from above to below. The transitions between two regions 11 form locking points 12 in which the connection points 10 can be mounted. Through a corresponding configuration of the connection points, the mount 5 can be arranged at different heights with respect to the base 4 of the surge chamber 1. A rod 6 of a pump holder 3 configured in this way can therefore be used for various possible applications.

What is claimed is:

1. A feed unit comprising:

a surge chamber having a base;

a filter disposed on said surge chamber base;

at least two rods having first and second ends, the first end of each rod passing through the filter and being physically mounted on said surge chamber base;

a cup-shaped pump holder mounted to said second ends of said rods remote from said surge chamber base;

wherein a fuel pump is arranged in the cup-shaped pump holder.

2. The feed unit according to claim 1, wherein the rods are arranged axially parallel to the axial extension of the fuel pump and the length of the rods between the mount and the base of the surge chamber corresponds approximately to the length of the fuel pump.

3. The feed unit according to claim 1, wherein the rods are fastened in the base of the surge chamber by means of a plug-in connection.

4. The feed unit according to claim 1, wherein the rods are connected to the base of the surge chamber by a material joint.

5. The feed unit according to claim 1, wherein the rods are formed integrally on the base of the surge chamber.

6. The feed unit according to claim 1, wherein the rods are connected to the pump holder by means of a plug-in connection.

7. The feed unit according to claim 6, wherein the diameter of the rods, starting at the end oriented away from the base of the surge chamber, increases in steps or continuously.

8. The feed unit according to claim 1, wherein the rods are formed in one piece with the mount.

9. A feed unit comprising:

a surge chamber having a base;

a filter proximate said surge chamber base;

a pump holder fastened in the surge chamber, the pump holder including a cup-shaped mount and at least two rods extending from the cup-shaped mount, through the filter, and to the base of the surge chamber to which base the rods are mounted; and a fuel pump arranged in the cup-shaped mount of the pump holder.

10. The feed unit according to claim 9, wherein the rods are arranged axially parallel to the axial extension of the fuel pump and the length of the rods between the mount and the base of the surge chamber corresponds approximately to the length of the fuel pump and wherein the rods are fastened in the base of the surge chamber by means of a plug-in connection or are connected to the base of the surge chamber by a material joint.

11. The feed unit according to claim 9, wherein the rods are formed integrally on the base of the surge chamber.

12. The feed unit according to claim 9, wherein the rods are connected to the mount by means of a plug-in connection and wherein the diameter of the rods, starting at the end oriented away from the base of the surge chamber, increases in steps or continuously.

13. The feed unit according to claim 9, wherein the rods are formed in one piece with the mount.

14. A method for manufacturing a feed unit comprising the steps of:

providing a surge chamber having a base;

disposing a filter in said surge chamber;

fastening at least two rods having first and second ends with their first ends extending through said filter and physically coupled to said surge chamber base;

fastening a cup-shaped pump holder to said second ends of said at least two rods remote from said surge chamber base; and arranging a fuel pump in the cup-shaped pump holder.

15. The method according to claim 14, wherein the rods are arranged axially parallel to the axial extension of the fuel pump and the length of the rods between the mount and the base of the surge chamber corresponds approximately to the length of the fuel pump.

16. The method according to claim 14, wherein the rods are fastened in the base of the surge chamber by means of a plug-in connection.

17. The method according to claim 14, wherein the rods are connected to the base of the surge chamber by a material joint.

18. The method according to claim 14, wherein the rods are formed integrally on the base of the surge chamber.

19. The method according to claim 14, wherein the rods are connected to the mount by means of a plug-in connection.

20. The method according to claim 19, wherein the diameter of the rods, starting at the end oriented away from the base of the surge chamber, increases in steps or continuously.

* * * * *